US008199942B2

(12) United States Patent
Mao

(10) Patent No.: US 8,199,942 B2
(45) Date of Patent: Jun. 12, 2012

(54) TARGETED SOUND DETECTION AND GENERATION FOR AUDIO HEADSET

(75) Inventor: Xiadong Mao, Foster City, CA (US)

(73) Assignee: Sony Computer Entertainment Inc., Tokyo (JP)

( * ) Notice: Subject to any disclaimer, the term of this patent is extended or adjusted under 35 U.S.C. 154(b) by 1098 days.

(21) Appl. No.: 12/099,022

(22) Filed: Apr. 7, 2008

(65) Prior Publication Data

US 2009/0252355 A1 Oct. 8, 2009

(51) Int. Cl.

| | |
|---|---|
| ***H04R 5/02*** | (2006.01) |
| ***H04R 5/027*** | (2006.01) |
| ***H04R 5/033*** | (2006.01) |
| *H04R 5/00* | (2006.01) |

(52) U.S. Cl. ..... 381/309; 381/370; 381/375

(58) Field of Classification Search ..... 381/309, 381/311, 74, 122, 370, 375, 376, 186
See application file for complete search history.

(56) References Cited

U.S. PATENT DOCUMENTS

| | | | | |
|---|---|---|---|---|
| 5,448,637 | A * | 9/1995 | Yamaguchi et al. | 379/430 |
| 5,715,321 | A * | 2/1998 | Andrea et al. | 381/92 |
| 5,815,582 | A * | 9/1998 | Claybaugh et al. | 381/71.6 |
| 6,771,780 | B2 * | 8/2004 | Hong et al. | 381/74 |
| 7,430,300 | B2 * | 9/2008 | Vosburgh et al. | 381/376 |
| 7,512,245 | B2 * | 3/2009 | Rasmussen et al. | 381/110 |
| 7,545,926 | B2 * | 6/2009 | Mao | 379/406.08 |
| 7,903,826 | B2 * | 3/2011 | Boersma | 381/57 |
| 2006/0013409 | A1 * | 1/2006 | Desloge | 381/72 |
| 2006/0083388 | A1 * | 4/2006 | Rothschild | 381/81 |
| 2006/0204016 | A1 * | 9/2006 | Pham et al. | 381/74 |
| 2006/0233389 | A1 | 10/2006 | Mao et al. | 381/92 |
| 2006/0239471 | A1 | 10/2006 | Mao et al. | 381/92 |
| 2007/0025562 | A1 | 2/2007 | Zalewski et al. | 381/92 |
| 2007/0260340 | A1 | 11/2007 | Mao | 700/94 |
| 2007/0274535 | A1 | 11/2007 | Mao | 381/94.1 |
| 2008/0165988 | A1 * | 7/2008 | Terlizzi et al. | 381/119 |
| 2008/0292111 | A1 * | 11/2008 | Park | 381/71.6 |
| 2009/0022343 | A1 * | 1/2009 | Van Schaack et al. | 381/309 |
| 2009/0196443 | A1 * | 8/2009 | Her et al. | 381/315 |
| 2009/0196454 | A1 * | 8/2009 | Her et al. | 381/380 |
| 2009/0252344 | A1 * | 10/2009 | Mao et al. | 381/74 |
| 2009/0268931 | A1 * | 10/2009 | Andrea et al. | 381/311 |
| 2010/0166204 | A1 * | 7/2010 | Yanagishita et al. | 381/71.6 |
| 2010/0215198 | A1 * | 8/2010 | Ngia et al. | 381/309 |
| 2010/0316225 | A1 * | 12/2010 | Saito et al. | 381/56 |
| 2011/0007927 | A1 * | 1/2011 | Hedrick et al. | 381/376 |
| 2011/0081036 | A1 * | 4/2011 | Brown | 381/375 |
| 2011/0150248 | A1 * | 6/2011 | Macours | 381/309 |
| 2011/0206217 | A1 * | 8/2011 | Weis | 381/74 |

* cited by examiner

*Primary Examiner* — Edgardo San Martin
(74) *Attorney, Agent, or Firm* — Joshua D. Isenberg; JDI Patent

(57) ABSTRACT

In an audio headset having one or more far-field microphones mounted to the headset; and one or more speakers mounted to the headset environmental sound may be recorded using the one or more far-field microphones and mixed with source media sound to produce a mixed sound. The mixed sound may then be played over the one or more speakers.

20 Claims, 2 Drawing Sheets

TARGETED SOUND DETECTION AND GENERATION FOR AUDIO HEADSET

FIELD OF THE INVENTION

Embodiments of this invention are related to computer gaming and more specifically to audio headsets used in computer gaming.

BACKGROUND OF THE INVENTION

Many video game systems make use of a headset for audio communication between a person playing the game and others who can communicate with the player's gaming console over a computer network. Many such headsets can communicate wirelessly with a gaming console. Such headsets typically contain one or more audio speakers to play sounds generated by the game console. Such headsets may also contain a near-field microphone to record user speech for applications such as audio/video (A/V) chat.

A recent development in the field of audio headsets for video game systems is the use of multi-channel sound, e.g., surround sound, to enhance the audio portion of a user's gaming experience. Unfortunately, the massive sound field from the headset tends to cancel out environmental sounds, e.g., speech from others in the room, ringing phones, doorbells and the like. To attract attention, it is often necessary to tap the user on the shoulder or otherwise distract him from the game. The user may then have to remove the headset in order to engage in conversation.

It is within this context that embodiments of the present invention arise.

BRIEF DESCRIPTION OF THE DRAWINGS

The teachings of the present invention can be readily understood by considering the following detailed description in conjunction with the accompanying drawings, in which.

DESCRIPTION OF THE SPECIFIC EMBODIMENTS

Figure 1:
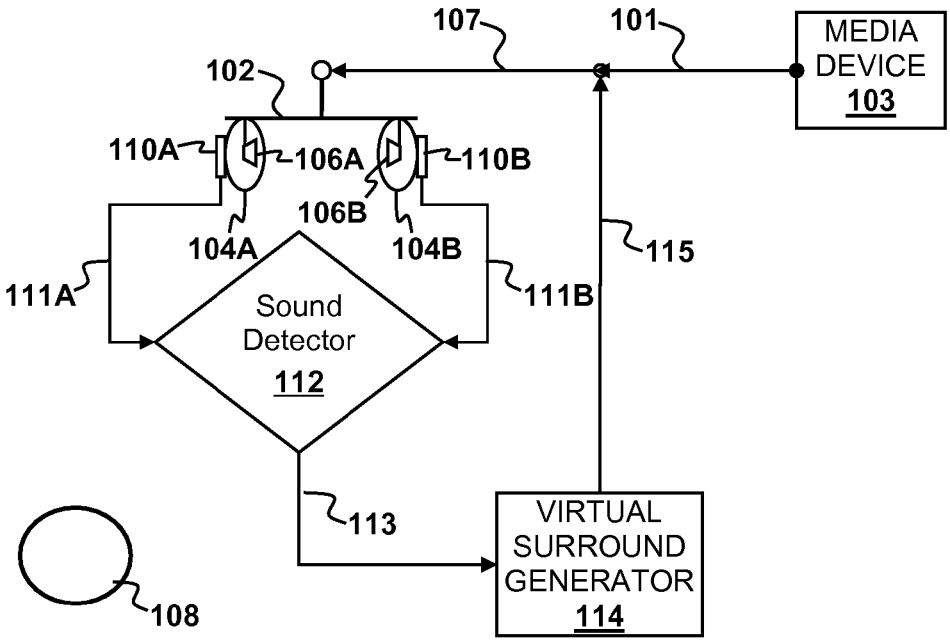
FIG. 1 is a schematic diagram illustrating of targeted sound detection and generation according to an embodiment of the present invention.

Although the following detailed description contains many specific details for the purposes of illustration, anyone of ordinary skill in the art will appreciate that many variations and alterations to the following details are within the scope of the invention. Accordingly, examples of embodiments of the invention described below are set forth without any loss of generality to, and without imposing limitations upon, the claimed invention.

According to an embodiment of the present invention, the disadvantages associated with the prior art may be overcome through the use of targeted sound detection and generation in conjunction with an audio headset. By way of example, the solution to the problem may be understood by referring to the schematic diagram shown in FIG. 1. A headset 102 having two earphones 104A, 104B receives a multi-channel source media sound signal 101 (e.g., surround sound) from a media device 103. As used herein the term "source media sound" refers to sounds generated in response to predetermined coded signals other than those generated in response to sounds recorded by the microphone(s). By way of example, source media sound may include, but are not limited to, sound generated by a television system, home theater system, stereo system, digital video recorder, video cassette recorder, video game console, personal computer, portable music or video player or handheld video game device.

As used herein, the term "multi-channel audio" refers to a variety of techniques for expanding and enriching the sound of audio playback by recording additional sound channels that can be reproduced on additional speakers. As used herein, the term "surround sound" refers to the application of multi-channel audio to channels "surrounding" the audience (generally some combination of left surround, right surround, and back surround) as opposed to "screen channels" (center, [front] left, and [front] right). Surround sound technology is used in cinema and "home theater" systems, games consoles and PCs, and a growing number of other applications. Consumer surround sound formats include sound on videocassettes, Video DVDs, and HDTV broadcasts encoded as Dolby Pro Logic, Dolby Digital, or DTS. Other surround sound formats include the DVD-Audio (DVD-A) and Super Audio CD (SACD) formats; and MP3 Surround.

Surround sound hardware is mostly used by movie productions and sophisticated video games. However, some consumer camcorders (particularly DVD-R based models from Sony) have surround sound capability either built-in or available as an add-on. Some consumer electronic devices (AV receivers, stereos, and computer soundcards) have digital signal processors or digital audio processors built into them to simulate surround sound from stereo sources.

It is noted that there are many different possible microphone and speaker configurations that are consistent with the above teachings. For example, for a five channel audio signal, the headset may be configured with five speakers instead of two, with each speaker being dedicated to a different channel. The number of channels for sound need not be the same as the number of speakers in the headset. Any number of channels greater than one may be used depending on the particular multi-channel sound format being used.

Examples of suitable multi-channel sound formats include, but are not limited to, stereo, 3.0 Channel Surround (analog matrixed: Dolby Surround), 4.0 Channel Surround (analog matrixed/discrete: Quadraphonic), 4.0 Channel Surround (analog matrixed: Dolby Pro Logic), 5.1 Channel Surround (3-2 Stereo) (analog matrixed: Dolby Pro Logic II), 5.1 Channel Surround (3-2 Stereo) (digital discrete: Dolby Digital, DTS, SDDS), 6.1 Channel Surround (analog matrixed: Dolby Pro Logic IIx), 6.1 Channel Surround (digital partially discrete: Dolby Digital EX), 6.1 Channel Surround (digital discrete: DTS-ES), 7.1 Channel Surround (digital discrete: Dolby Digital Plus, DTS-HD, Dolby TrueHD), 10.2 Channel Surround, 22.2 Channel Surround and Infinite Channel Surround (Ambisonics).

In the multi-channel sound format notation used above, the number before the decimal point in a channel format indicates the number of full range channels and a 1 or 0 after the decimal indicates the presence or absence limited range low frequency effects (LFE) channel. By way of example, if a 5.1 channel surround sound format is used, there are five full range channels plus a limited range LFE channel. By contrast in a 3.0 channel format there are three full range channels and there is no LFE channel.

Each of the earphones includes one or more speakers 106A, 106B. The different signal channels in the multi-channel audio signal 101 are distributed among the speakers 106A, 106B to produce enhanced sound. Normally, this sound would overwhelm any environmental sound. As used herein, the term "environmental sound" refers to sounds, other than source media sounds, generated from sound sources in the environment in which the headset 102 is used. For example, if the headset 102 is used in a room, environment sounds include sounds generated within the room. By way of example, an environmental sound source 108 may be another person in the room or a ringing telephone.

To allow a user to realistically hear targeted sounds from the environmental source 108 the headset 102 includes one or more microphones. In particular, the headset may include far-field microphones 110A, 110B mounted to the earphones 104A, 104B. The microphones 110A, 110B are configured to detect environmental sound and produce microphone signals 111A, 111B in response thereto. By way of example, the microphones 110A, 110B may be positioned and oriented on the earphones 104A, 104B such that they primarily receive sounds originating outside the earphones, even if a user is wearing the headset. By contrast, prior art noise canceling headphones may include microphones within the earphones of a headset. However, in such cases, the microphones are positioned and oriented to detect sounds coming from the speakers within the headphones, particularly if a user is wearing the headset.

In certain embodiments of the invention, the microphones 110A, 110B may be far-field microphones. It is further noted that two or more microphones may be placed in close proximity to each other (e.g., within about two centimeters) in an array located on one of the earphones.

The microphone signals 111A, 111B may be coupled to an environment sound detector 112 that is configured to detect and record sounds originating from the environmental sound source 108. The environmental sound detector 112 may be implemented in hardware or software or some combination of hardware and software. The environmental sound detector 112 may include some sort of sound filtering to remove background noise or other undesired sound. The environmental sound detector produces an environmental sound signal 113.

Where two or more microphones are used, the environmental sound signal 113 may include environmental sound from the microphones 110A, 110B in both earphones. The environmental sound signal 113 may take into account differences in sound intensity arriving at the microphones 110A, 110B. For example, in FIG. 1, the environmental sound source 108 is slightly closer to microphone 110A than to microphone 110B. Consequently, it is reasonable to expect that the sound intensity at microphone 110A is higher than at microphone 110B. The difference in sound intensity between the two microphones may be encoded in the environmental sound signal 113. There are a number of different ways of generating the environmental sound signal to take into account differences in sound intensity due to the different locations of the microphones 110A, 110B, e.g., using blind source separation or semi-blind source separation.

In some embodiments, the two microphones 110A, 110B may be mounted on each side of an earphone and structured as two-microphone array. Array beam-forming or maybe simple coherence based sound-detection technology (so called "music" algorithm) may be used to detect the sound and determine the direction from sound source origination to the array geometry center as well.

By way of example, and without loss of generality, the environmental sound signal 113 may be a discrete time domain input signal $x_m(t)$ produced from an array of two or more microphones. A listening direction may be determined for the microphone array. The listening direction may be used in a semi-blind source separation to select the finite impulse response filter coefficients $b_0, b_1 \ldots, b_N$ to separate out different sound sources from input signal $x_m(t)$. One or more fractional delays may optionally be applied to selected input signals $x_m(t)$ other than an input signal $x_0(t)$ from a reference microphone $M_0$. Each fractional delay may be selected to optimize a signal to noise ratio of a discrete time domain output signal y(t) from the microphone array. The fractional delays may be selected to such that a signal from the reference microphone $M_0$ is first in time relative to signals from the other microphone(s) of the array. A fractional time delay Δ may optionally be introduced into an output signal y(t) so that: $y(t+\Delta)=x(t+\Delta)*b_0+x(t-1+\Delta)*b_1+x(t-2+\Delta)*b_2+\ldots+x(t-N+\Delta)b_N$, where Δ is between zero and ±1 and $b_0, b_1, b_2 \ldots b_N$ are finite impulse response filter coefficients.

Fractional delays and semi-blind source separation and other techniques for generating an environmental sound signal to take into account differences in sound intensity due to the different locations of the microphones are described in detail in commonly-assigned US Patent Application publications 20060233389, 20060239471, 20070025562, and 20070260340, the entire contents of which are incorporated herein by reference for all purposes.

A multi-channel sound generator 114 receives the environmental sound signal 113 from the environmental sound detector 112 and generates a multi-channel signal environmental sound signal 115. The multi-channel environmental sound signal 115 is mixed with the source media sound signal 101 from the media device 103. The resulting mixed multi-channel signal 107 is played over the speakers in the headset 102. Thus, environmental sounds from the sound source 108 can be readily perceived by a person wearing the headset and listening to source media sound from the media device 103. The environmental sound reproduced in the headset can have a directional quality resulting from the use of multiple microphones and multi-channel sound generation. Consequently, the headset-wearer could perceive the sound coming from the speakers 106A, 106B as though it originated from the specific location of the sound source 108 in the room as opposed to originating from the media device 103.

Figure 2:
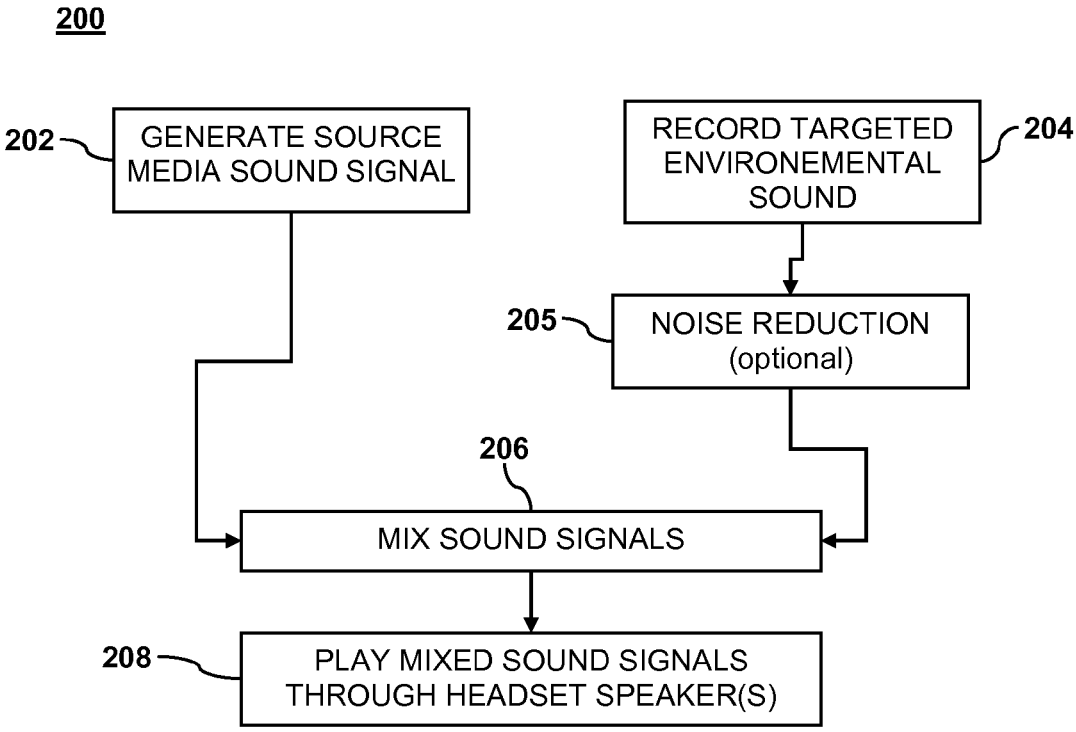
FIG. 2 is a flow diagram illustrating a method for targeted sound detection and generation according to an embodiment of the present invention.

FIG. 2 illustrates a flow diagram of a method 200 for sound detection and generation in an audio system of the type shown in FIG. 1. Specifically, at 202 source media sound signals are generated, e.g., from a music player, video player, or video game device. Targeted environmental sound is recorded with one or more headset microphones, to produce an environmental sound signal as indicated at 204. Noise reduction may be performed on the recorded environmental sound signal, as indicated at 205. Delay filtering may be used to determine the location of a particular source of sound within the environmental sound signal. The recorded environmental sound signal (with or without noise reduction) is then mixed with the source media sound signal, as indicated at 206, thereby producing a mixed sound containing both the source media sound and the environmental sound. By way of example, if the source media sound is a 5.1 channel surround sound signal, the targeted sound from the particular source may be mixed with the source media sound as a 5.1 channel signal and mixed with the source media signal. The mixed sound is played over one or more speakers in the headset as indicated at 208.

It is noted that embodiments of the present invention include the possibility that the headset 102 may have a single far-field microphone. In such a case, the signal from the single microphone may be mixed to all of the channels of a multi-channel source media signal. Although, this may not provide the headset user with a full multi-channel sound experience for the environmental sounds, it does allow the headset user to perceive targeted environmental sounds while still enjoying a multi-channel sound experience for the source media sounds.

Figure 3:
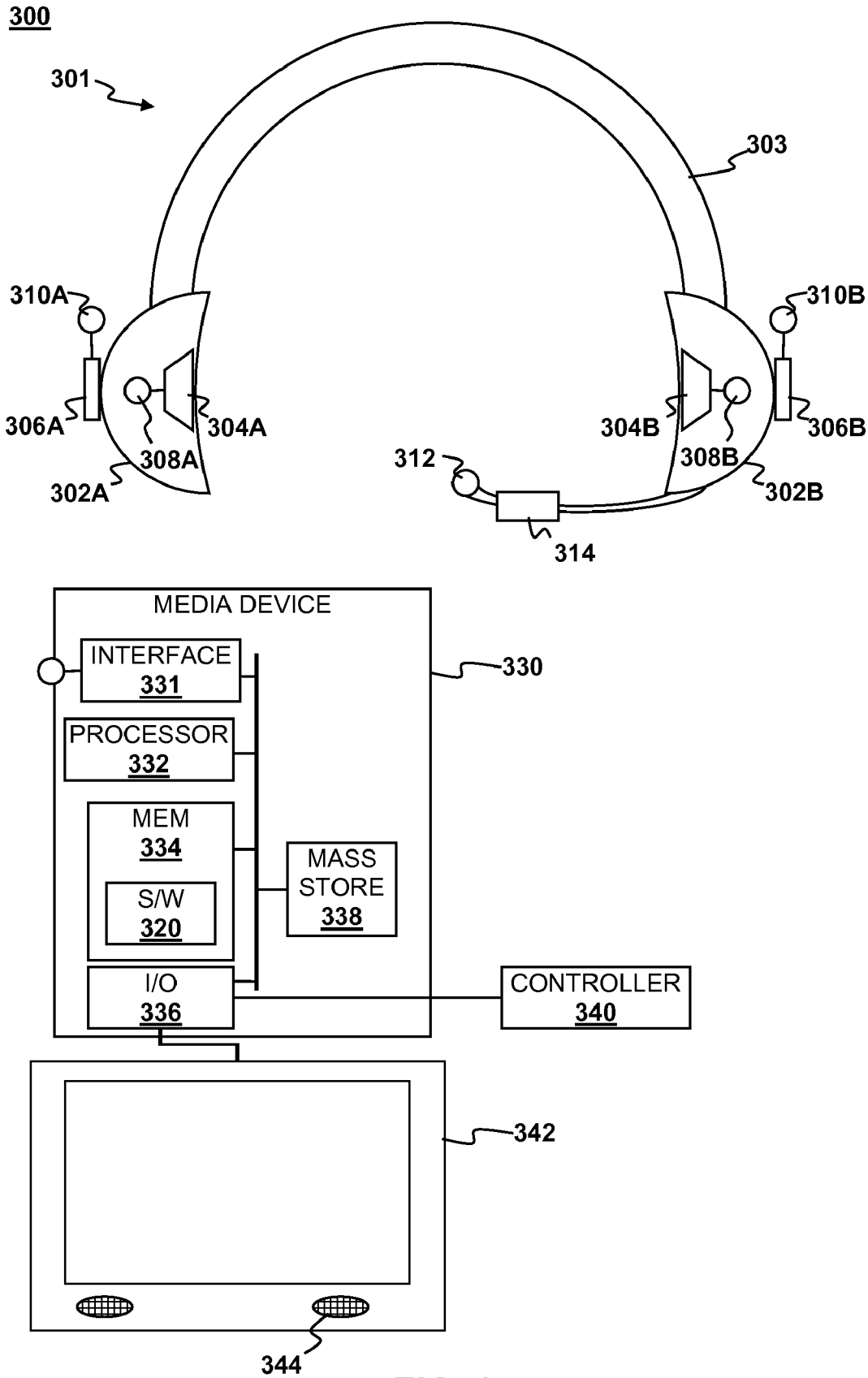
FIG. 3 is a schematic diagram of an audio system utilizing according to an embodiment of the present invention.

According to an alternative embodiment of the present invention, targeted sound detection and generation may be implemented an audio system 300 may be configured as shown in FIG. 3. The system 300 may include a headset 301 that is interoperable with a media device 330. The headset 301 may include a headpiece such as one or more headphones 302A, 302B, each containing one or more speakers 304A, 304B. In the example depicted in FIG. 3, speakers 304A, 304B are respectively positioned and oriented on the earphones 302A, 302B such that they direct sound toward a user's ears when the user wears the headset. The two earphones 304A, 304B may be mechanically connected to each other by a resilient headband 303 to facilitate mounting of the headset to a user's head. Alternatively, the earphones 302A, 302B may be separately mountable to a user's ears. One or more far-field microphones 306A, 306B may be mounted to the headpiece 301. In the example depicted in FIG. 3, microphones 306A, 306B are respectively mounted to earphones 302A, 302B. The microphones 306A, 306B are positioned and oriented on the earphones 302A, 302B such that they can readily detect sound originating outside the earphones when the user wears the headset.

The headset 301 may include speaker communication interfaces 308A, 308B that allow the speakers to receive source media signals from the source media device 330. The speaker communication interfaces 308A, 308B may be configured to receive signals in digital or analog form from the source media device 330 and convert them into a format that the speakers may convert into audible sounds. Similarly, the headset 301 may include microphone communication interfaces 310A, 310B coupled to the microphones 306A, 306B. The microphone communication interfaces 310A, 310B may be configured to receive digital or analog signals from the microphones 306A, 306B and convert them into a format that can be transmitted to the media device 330. By way of example, any or all of the interfaces 308A, 308B, 310A, 310B may be wireless interfaces, e.g., implemented according to a personal area network standard, such as the Bluetooth standard. Furthermore the functions of the speaker interfaces 308A, 308B and microphone interfaces 310A, 310B may be combined into one or more transceivers coupled to both the speakers and the microphones.

In some embodiments, the headset 301 may include an optional near-field microphone 312, e.g., mounted to the band 303 or one of the earphones 302A, 302B. The near-field microphone may be configured to detect speech from a user of the headset 300, when the user is wearing the headset 301. In some embodiments, the near-field microphone 312 may be mounted to the band 303 or one of the earphones 302B by a stem 313 that is configured to place the near-field microphone in close proximity to the user's mouth. The near-field microphone 312 may transmit signals to the media device 330 via an interface 314.

As used herein, the terms "far-field" and "near-field" generally refer to the sensitivity of microphone sensor, e.g., in terms of the capability of the microphone to generate a signal in response to sound at various sound wave pressures. In general, a near-field microphone is configured to sense average human speech originating in extremely close proximity to the microphone (e.g., within about one foot) but has limited sensitivity to ordinary human speech originating outside of close proximity. By way of example, the near-field microphone 312 may be a −46 dB electro-condenser microphone (ECM) sensor having a range of about 1 foot for average human voice level.

A far-field microphone, by contrast, is generally sensitive to sound wave pressures greater than about −42 dB. For example, the far-field microphones 306A, 306B may be ECM sensors capable of sensing −40 dB sound wave pressure. This corresponds to a range of about 20 feet for average human voice level.

It is noted, there are other types of microphone sensors that are potentially capable of sensing over both the "far-field" and "near-field" ranges. Any sensor may be "far-field" as long as it is capable of sensing small wave pressure, e.g., greater than about −42 db).

The definition of "near-field" is also meant to encompass technology which may use an different approaches to generating a signal in response to human speech generated in close proximity to the sensor. For example, a near-field microphone may use a material that only resonates if sound is incident on it within some narrow range of incident angles. Alternatively, a near-field microphone may detect movement of the bones of the middle ear during speech and re-synthesizes a sound signal from these movements.

The media device may be any suitable device that generates source media sounds. By way of example, the media device 330 may be a television system, home theater system, stereo system, digital video recorder, video cassette recorder, video game console, portable music or video player or handheld video game device. The media device 330 may include an interface 331 (e.g., a wireless transceiver) configured to communicate with the speakers 302A, 302B, the microphones 306A, 306B and 312 via the interfaces 308A, 308B, 310A, 310B and 314. The media device 330 may further include a computer processor 332, and a memory 334 which may both be coupled to the interface 331. The memory may contain software 320 that is executable by the processor 332. The software 320 may implement targeted sound source detection and generation in accordance with embodiments of the present invention as described above. Specifically, the software 320 may include instructions that are configured such that when executed by the processor, cause the system 300 to record environmental sound using one or both far-field microphones 310A, 310B; mix the environmental sound with source media sound from the media device 330 to produce a mixed sound; and play the mixed sound over one or more of the speakers 304A, 304B. The media device 330 may include a mass storage device 338, which may be coupled to the processor and memory. By way of example, the mass storage device may be a hard disk drive, CD-ROM drive, Digital Video Disk drive, Blu-Ray drive, flash memory drive, and the like that can receive media having data encoded therein formatted for generation of the source media sounds by the media device 330. By way of example, such media may include digital video disks, Blu-Ray disks, compact disks, or video game disks. In the particular case of video game disks, at least some of the source media sound signal may be generated as a result a user playing the video game. Video game play may be facilitated by a video game controller 340 and video monitor 342 having speakers 344. The video game controller 340 and video monitor 342 may be coupled to the processor 332 through input/output (I/O) functions 336.

While the above is a complete description of the preferred embodiment of the present invention, it is possible to use various alternatives, modifications and equivalents. Therefore, the scope of the present invention should be determined not with reference to the above description but should, instead, be determined with reference to the appended claims, along with their full scope of equivalents. Any feature described herein, whether preferred or not, may be combined with any other feature described herein, whether preferred or not. In the claims that follow, the indefinite article "A" or "An" refers to a quantity of one or more of the item following the article, except where expressly stated otherwise. The appended claims are not to be interpreted as including means-plus-function limitations, unless such a limitation is explicitly recited in a given claim using the phrase "means for".

What is claimed is:

1. In an audio headset having two or more far-field microphones mounted to the headset; and one or more speakers mounted to the headset, a method for sound detection and generation, the method comprising:

recording environmental sound using the two or more far-field microphones;

using coherence based sound-detection technology to calculate the direction-of-arrival of the environmental sound recorded by the two or more far-field microphones;

mixing the environmental sound with source media sound to produce a mixed sound that retains the direction-of-arrival of the environmental sound; and playing the mixed sound over the one or more speakers.

2. The method of claim 1 wherein the two or more far-field microphones include two or more far-field microphones and the one or more speakers include two or more speakers.

3. The method of claim 2 wherein mixing the environmental sound with source media sound includes generating a multi-channel sound that includes the ambient room sounds.

4. The method of claim 3 wherein the multi-channel sound includes five sound channels.

5. The method of claim 4 wherein the two or more speakers include five or more speakers.

6. The method of claim 1 wherein the source media sound includes sound generated by a television system, home theater system, stereo system, digital video recorder, video cassette recorder, video game console, portable music or video player or handheld video game device.

7. The method of claim 1 wherein the two or more far-field microphones are configured to detect ambient noise originating outside the headset.

8. The method of claim 1, further comprising performing noise reduction on the environmental sound after it has been recorded and before mixing it with the source media sound.

9. An audio system, comprising:

a headset, adapted to mount to a user's head, having two or more far-field microphones mounted to the headset; and one or more speakers mounted to the headset, a processor coupled to the two or more far-field microphones and the one or more speakers;

a memory coupled to the processor;

a set of processor-executable instructions embodied in the memory, wherein the instructions are configured, when executed by the processor to implement a method for sound detection and generation, wherein the method comprises:

recording environmental sound using the two or more far-field microphones;

using coherence based sound-detection technology to calculate a direction-of-arrival of the environmental sound recorded by the two or more far-field microphones;

mixing the environmental sound with source media sound to produce a mixed sound that retains the direction-of-arrival of the environmental sound; and playing the mixed sound over the one or more speakers.

10. The system of claim 9 wherein the two or more far-field microphones include two or more far-field microphones and the one or more speakers include two or more speakers.

11. The system of claim 9 wherein mixing the environmental sound with source media sound include multi-channel sound that includes the ambient room sounds.

12. The system of claim 9 wherein the multi-channel sound includes five sound channels.

13. The system of claim 9 wherein the processor is located on a console device, the system further comprising a wireless transceiver on the console device coupled to the processor, a wireless transmitter mounted to the headset coupled to the two or more far-field microphones, and a wireless receiver mounted to the headset coupled to the one or more speakers.

14. The system of claim 9 wherein the two or more far-field microphones are configured to detect environmental sounds originating outside the headset.

15. The system of claim 13 wherein the two or more far-field microphones are configured to detect environmental sounds originating outside the headset while a user is wearing the headset.

16. An audio headset, comprising:

a headpiece adapted to mount to a user's head;

two or more far-field microphones mounted to the headpiece; and one or more speakers mounted to the headpiece;

wherein the headset is configured to record environmental sound using the two or more far-field microphones, use coherence based sound detection technology to calculate a direction-of-arrival of the environmental sound recorded by the two or more far-field microphones, mix the environmental sound with source media sound to produce a mixed sound that retains the direction-of-arrival of the environmental sound, and play the mixed sound over the one or more speakers.

17. The audio headset of claim 16 wherein the two or more far-field microphones are configured to detect environmental sounds originating outside the headset.

18. The audio headset of claim 16 wherein the two or more far-field microphones are configured to detect environmental sounds originating outside the headset while a user is wearing the headset.

19. The audio headset of claim 16, further comprising a wireless transmitter mounted to the headpiece and coupled to the two or more far-field microphones.

20. The audio headset of claim 18, further comprising a wireless receiver mounted to the headpiece and coupled to the one or more speakers.

* * * * *